United States Patent [19]

Butler et al.

[11] 4,283,718

[45] Aug. 11, 1981

[54] DOOR ALARM DEVICE

[75] Inventors: Edward A. Butler, North Kingstown; Francis R. Savoie, Pawtucket, both of R.I.

[73] Assignee: Synco National Ltd., Providence, R.I.

[21] Appl. No.: 54,165

[22] Filed: Jul. 2, 1979

[51] Int. Cl.[3] ..... G08B 13/06

[52] U.S. Cl. ..... 340/545; 200/61.67; 200/61.93; 340/542

[58] Field of Search ..... 340/542, 545; 200/61.64, 61.67, 61.93

[56] References Cited

U.S. PATENT DOCUMENTS

| | | | |
|---|---|---|---|
| 1,012,384 | 12/1911 | Lyon | 200/61.67 |
| 2,170,521 | 8/1939 | Rodth | 340/542 |
| 2,287,572 | 6/1942 | Rodth | 200/61.67 X |
| 2,295,482 | 9/1942 | Kemp | 200/61.67 X |
| 3,530,262 | 9/1970 | Hawkins | 340/545 X |
| 3,587,080 | 6/1971 | Hawkins | 340/542 |
| 3,755,802 | 8/1973 | Bobrowski et al. | 340/542 |
| 3,810,145 | 5/1974 | Gusaras | 340/542 |
| 4,029,919 | 6/1977 | Lumme | 340/545 |
| 4,176,347 | 11/1979 | McIntyre | 340/545 |

*Primary Examiner*—John W. Caldwell, Sr.
*Assistant Examiner*—Joseph E. Nowicki
*Attorney, Agent, or Firm*—Robert J. Doherty

[57] ABSTRACT

A signalling device for use in combination with a door so as to signal when the door is attempted to be opened as by inward pivotal motion with respect to the frame in which such door is supported. Normally the alarm is an audible one such as a horn or siren, and in this manner, attempts to open the door are brought to the attention of those inside the structure. The device functions as a dead bolt lock and the signal aspect of the device may be overridden by a key-operated deactivation assembly. Generally the device operates by means of a transversely slidable bolt which may have electrical contact on the inner surface thereof for engagement with a contact on the inside of the door or housing attached thereto. Other contact locations are also contemplated. The bolt may be spring biased away from the door or housing contact and an appropriate electrical circuit is closed and the signal activated upon door movement as by attempted entry.

5 Claims, 13 Drawing Figures

DOOR ALARM DEVICE

BACKGROUND AND SUMMARY OF THE INVENTION

This invention relates to a security device and more particularly to an alarm which signals attempted entry to a structure such as ones house via an entry door provided therein. As such, the device is not intended to be a primary lock to prevent entry, but a signal, such that the occupants of the structure may be aware of such attempted entry. The device does however function as a dead bolt lock. It may be also utilized with windows and with sliding, rather than pivotal doors.

Various signal devices to indicate the unauthorized entry into a structure are known and include pressure-sensitive switches which may be placed under carpeting, mats, and the like, or which may be incorporated into a separate wedge-shaped element in turn jammed underneath the bottom of the door or at a point inwardly disposed therefrom, as well as wave-form beams such as a light path which may be interrupted and in turn trigger a signal or alarm. Although generally operable for their intended purposes such devices have inherent drawbacks. For example, the wedge-shaped pressure-sensitive switches may be simply kicked aside by an intruder and the light beam and carpet underlay switches may be avoided by the intruder by his respective movements therebeneath and avoiding walking on entranceway mats and the like.

It is accordingly an object of the present invention to provide a signalling device in combination with a door lock which is of straightforward, relatively simple design, and which can accordingly be sold for a reasonable price and accordingly gain wide consumer acceptance.

A still further object of the present invention is the provision of a door alarm device of the aforementioned type which signals attempted entry by relative, i.e. inward movement of the door with respect to its supporting frame and which is easily adjusted such that even slight inward pressure upon the outside surface of the door triggers the alarm.

Another object of the invention is the provision of a door alarm of the aforementioned type which may be easily deactivated by authorized persons.

These and other objects of the present invention are accomplished by a device adapted for attachment to the inside surface of a door supported for relative, i.e. pivotal movement with respect to a door frame. The device includes a housing and an elongated bolt adapted to slide back and forth with respect to the housing and the door on which it is supported between a first non-activatable position wherein the door may be freely opened and a second activatable position in which attempted opening of the door will trigger the alarm. The bolt is provided with an electrical contact disposed in a spaced position from a similar contact provided in the housing. Spring means are provided so as to normally bias the bolt away from the door and so as to maintain the spaced relationship of the contacts except when such is overcome by door movement accompanying attempted entry such that the contacts engage each other and accordingly activate appropriate electrical circuitry so as to cause the signal to be given, i.e. an audible alarm. In the activatable position of the bolt, one end thereof is engaged by a latch strike mounted on the door frame such that the bolt is held in fixed position with respect to the frame and such that relative movement of the door with respect to the bolt may be achieved. A key-operated assembly including a rotatable finger may be mounted in the door and serve to move the bolt between its first and second positions and thus deactivate the device to authorized persons from the outside of the structure. This deactivation assembly may, however, be purposely overridden by the occupant from the inside of the structure.

Other objects, features, and advantages of the invention shall become apparent as the description thereof proceeds when considered in connection with the accompanying drawings.

DESCRIPTION OF THE DRAWINGS

In the drawings which illustrate the best mode presently contemplated for carrying out the present invention.

DESCRIPTION OF THE INVENTION

Figure 1:
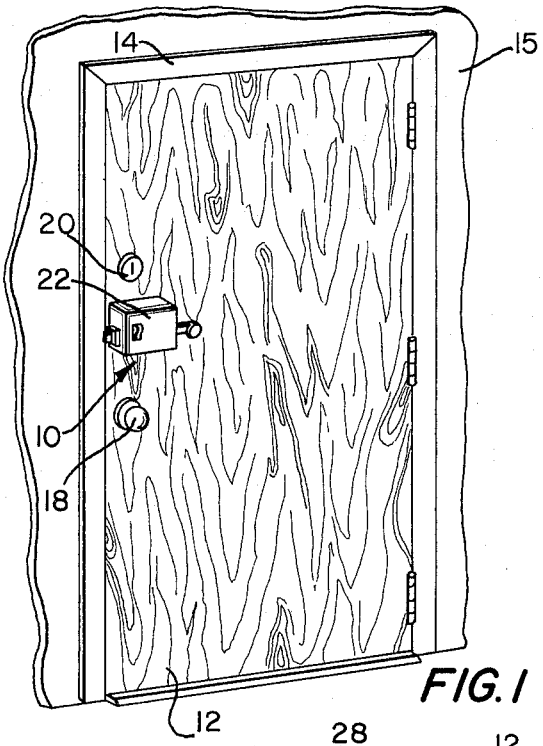
FIG. 1 is a perspective view showing a door provided with a door alarm device of the present invention.
Figure 2:
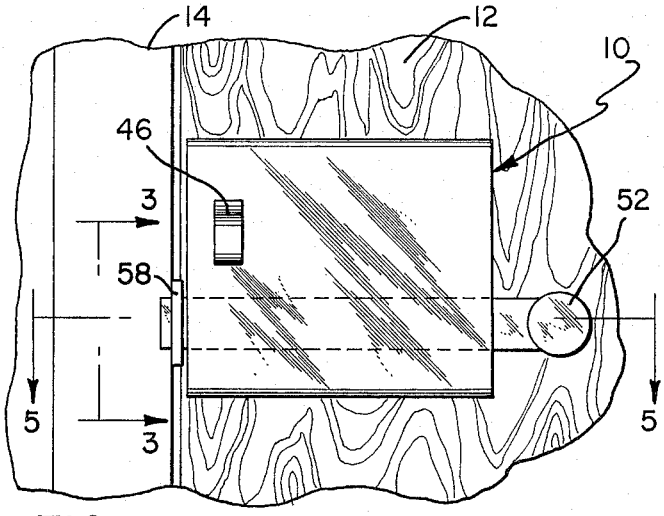
FIG. 2 is an enlarged elevational view of a portion of FIG. 1.
Figure 3:
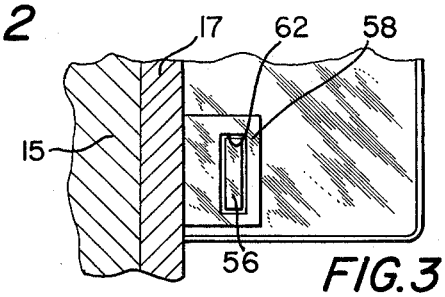
FIG. 3 is a side sectional view taken along the line 3—3 of FIG. 2.
Figure 4:
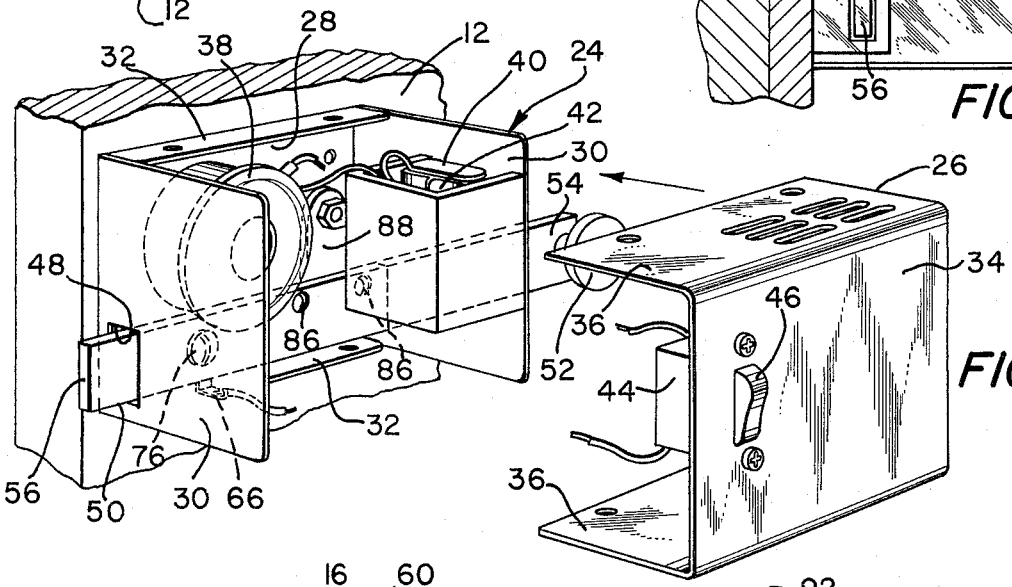
FIG. 4 is a perspective view of the device of the present invention in partially disassembled form, that is, with the cover portion thereof removed.

The device 10 of the present invention is shown mounted in the inside surface of a conventional door 12 mounted within the door frame 14 of a structure 15. The frame includes a stud 16 and finish framing 17. The door 12 includes the normal hardware, i.e. a doorknob 18, and a separate door lock 20. As will hereinafter be more fully explained, the device 10 of the present invention, although it functions as an additive dead bolt lock it is not primarily intended to replace the lock 20 of the door 12, but rather to signal attempted entry from the outside of the structure as by the inward movement of the door 12 with respect to the frame 14 in which it is mounted for inward pivotal movement in the normal manner.

Figure 13:
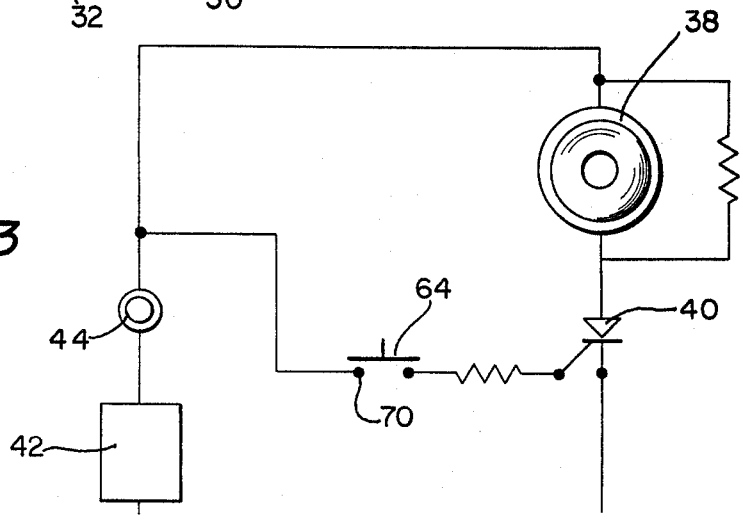
FIG. 13 is a circuit diagram of the device.

The device 10 includes a housing 22 in turn having a generally U-shaped base 24 and a similarly shaped cover 26. The base and cover portions 24, 26 are adapted to interengage with each other so as to form the overall box-like configuration of the housing 22. The base 24 includes a back wall 28 and side walls 30 upstanding therefrom. The back wall also includes flanges 32 extendng between said side walls 30. The cover portion 26 includes a top panel 34 from which side panels 36 downwardly extend. A horn, siren, or other sounding device 38 may be mounted on the back wall 28 and is wired by appropriate circuitry such as shown in FIG. 13 to an SCR 40 and a battery power supply 42 conventionally mounted on one of the side walls 30. A reset switch 44 is mounted on the inside surface of the top panel 34 and is controlled by a manually operable button 46 such that once the horn 38 or other sounding device has been activated, the power thereto may be temporarily disconnected by manipulation of the button 46 to shut off the alarm and in effect to reset the device for subsequent activated use.

The side walls 30 of the housing 24 are each provided with an opening 48 which openings are horizontally aligned with each other and adapted to receive an elongated bolt 50 therein. The bolt is adapted to transversely slide within the openings 48 as by manipulation by a handle 52 included at one end 54 thereof. The other end 56 of the bolt is adapted to contact a strike 58 attached to the stud 16 of the frame 14 as with screws 60. The strike 58 inwardly extends from the frame 14 and is provided with a slot 62 into which end 56 of the bolt 50 is adapted to extend.

Figure 5:
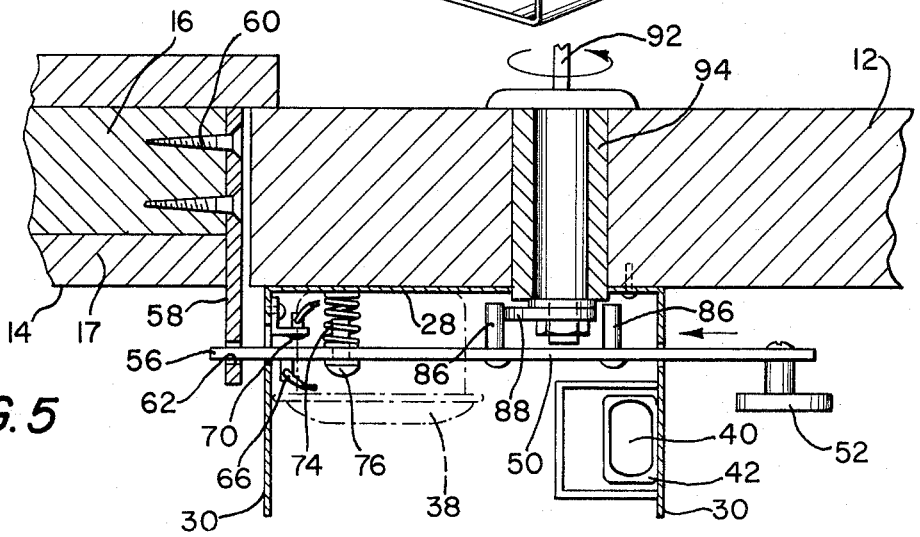
FIG. 5 is a sectional view of the door, door frame, and the device of the present invention taken along the line 5—5 of FIG. 2 wherein the device is depicted in its activatable position.
Figure 6:
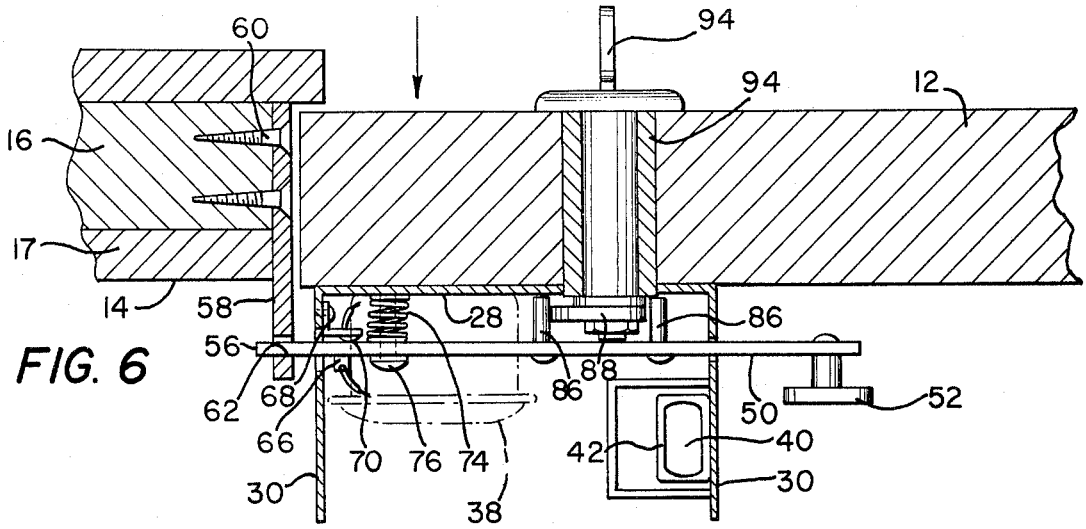
FIG. 6 is a view similar to FIG. 5, showing the device in its activated position as by the inward movement of the door as with attempted entry.
Figure 8:
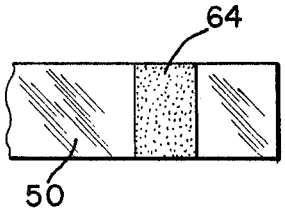
FIG. 8 is a partial elevational view showing a portion of the inner surface of the bolt.
Figure 10:
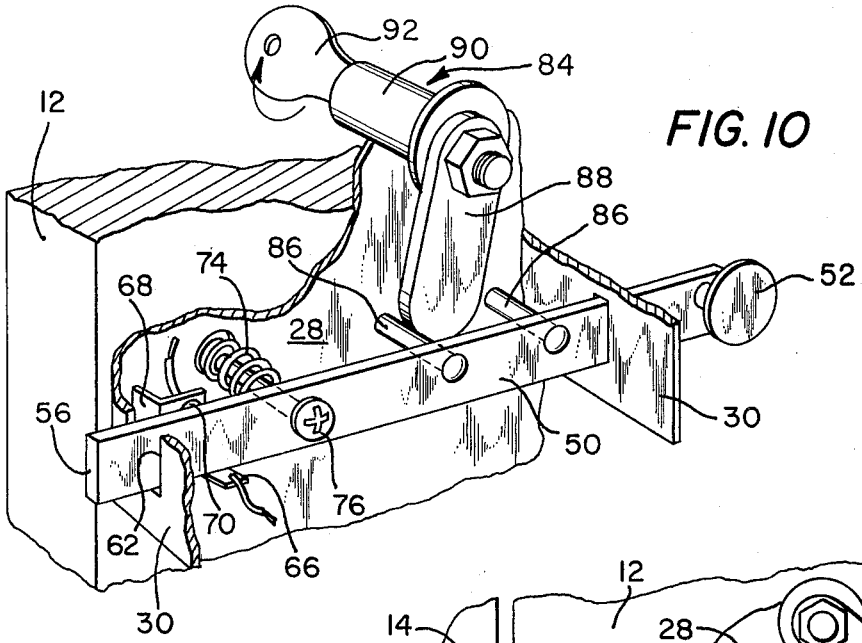
FIG. 10 is a perspective view showing in particular the manner in which the key-operated assembly may be used to activate or deactivate the device.

As best shown in FIG. 8, the inner surface of the bolt 50 is provided with an electrical contact 64 insulated from the body of the bolt 50 which is normally formed of any suitable metal as by the application of an initial insulating strip thereto (not shown) and on which the contact strip or coating 64 is applied. The contact 64 is in turn provided with a lead 66 to which suitable wiring may be attached. The side wall 30 which is proximal to the edge of the door 12 is provided on the inside surface thereof with an inwardly and outwardly slidable L-shaped plate 68 on which an electrical contact 70 is mounted. This housing contact 70 is thus movable towards and away from the bolt contact 64 as by means of an elongated slot (not shown) in the plate 68 and attached to the side wall 30 by means of a headed screw 72 so as to provide an adjustment in the sensitivity of the device 10. Accordingly, as the bolt 50 is slid to the left as shown in FIG. 5, the contacts 64 and 70 are aligned but in spaced relationship to each other and accordingly the device is disposed in an activatable position, that is, when disposed in such position, if the door 12 is moved relative to the bolt 50 such that the contacts engage each other, suitable electrical connection will be made so as to sound the alarm to indicate attempted entry. In this regard the device 10 includes a coil spring 74 disposed between the back wall 28 and the bolt 50 which spring 74 is disposed about a screw 76 provided through the body of the bolt 50. In this manner then, the spring 74 continually urges the bolt contact 64 away from the housing contact 70. However when the bolt is disposed in its activatable position, as shown in FIG. 5, such that the end 56 thereof is disposed within the strike slot 62, relative movement between the door and the bolt may take place since the bolt is held in a stationary position by means of the strike 58. In such position inward movement of the door relative to the frame 14 also causes the door to move relative to the bolt 50 and thus bring the contacts 64 and 70 into engagement with each other as shown in FIG. 6 of the drawings.

Figure 7:
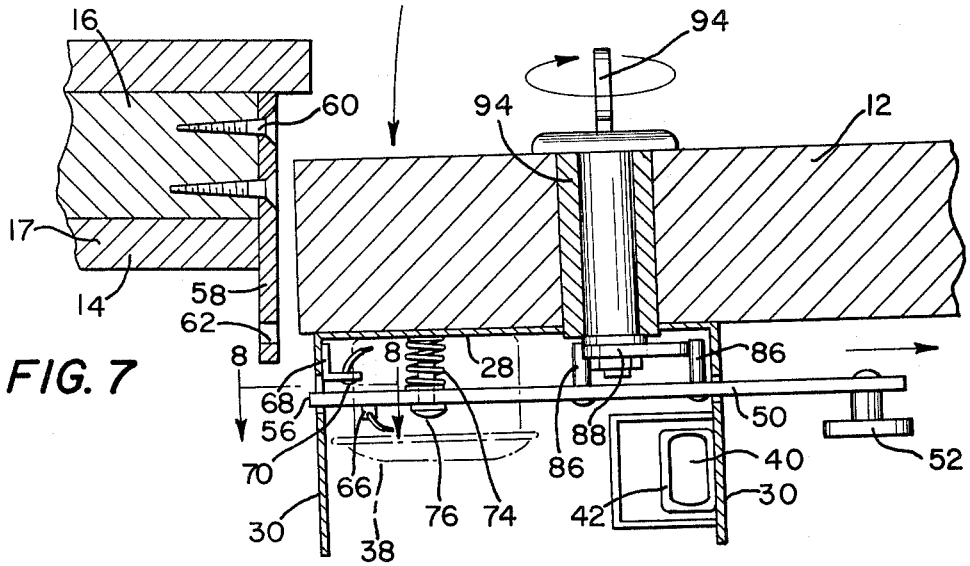
FIG. 7 is a sectional view similar to FIGS. 5 and 6 but showing the device in its non-activatable position such that the door may be freely opened without sounding the alarm.

The bolt 50 is also adapted to be moved into a non-activatable position as shown in FIG. 7 of the drawings. Therein the bolt is shown as having been slid to the right such that the bolt contact 64 is misaligned with the housing contact 70. In this position, opening of the door cannot cause the contacts to be placed in electrical engagement with each other for two reasons: one, that they are not aligned with each other; and two, since the end 56 of the bolt is not maintained in a stationary position by its engagement with the latch 58. In the FIG. 7 position, the door, the housing, and the bolt thus move as a unit, and accordingly the contacts 64 and 70 are maintained in spaced but misaligned attitude with respect to each other by means of the continual urging of the spring 74.

Figure 9:
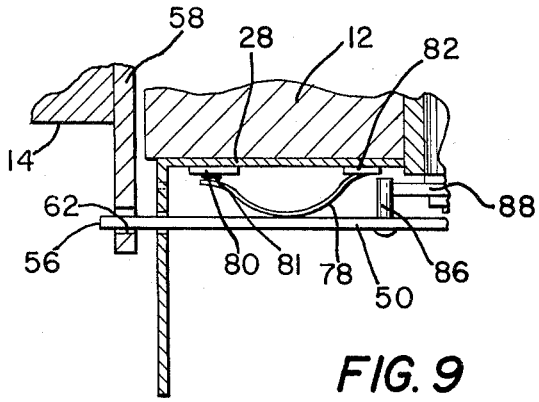
FIG. 9 is a partial sectional view showing a modified form of the invention wherein a leaf spring is utilized as the means by which appropriate electrical contact is provided to signal relative door movement.

Turning now to FIG. 9 of the drawings, an alternate embodiment of the device is depicted in the normal inactive position of the device. Therein a leaf spring 78 of generally U-shaped configuration has been mounted on the back wall 28 as by fixed attachment to an electrically conductive pad 82 at one end thereof and in normally spaced position at its other end with an electrically insulative pad 80 having a contact 81 positioned on its face and in opposition to the other spring end. The central portions of the leaf spring are in contact or adapted to contact the inside surface of the bolt 50 and in this manner, then, as the door moves towards an open position the other end of the spring will engage contact 81 to close the electrical circuit and thus signal attempted entry. In such embodiment at that portion of the bolt contacting the spring 78 is insulated or the spring includes an insulative covering at least in such mutual contact area.

The device 10 may further be provided with a key-operated deactivation assembly 84. Such assembly includes a pair of pins 86 attached to the bolt 50 at one end thereof and inwardly extending towards the back wall 28. The pins 86 are transversely (horizontally) spaced from each other and are engageable by a generally vertically downwardly extending actuation finger 88 normally disposed between the pins. The upper end of the actuation finger 88 is bolted to an at least partially rotatable cylinder 90 operable by a key 92. The cylinder 90 is in turn disposed within the door 12 within an appropriate mounting shell 94. Thus arcuate movement of the key 92 serves to turn the barrel 90 and thus effect back and forth pivotal movement of the actuation finger 88.

Thus when one desires to leave the structure and activate the device 10, the door may be closed and locked in the normal manner as by lock 20, and thereafter the key 92 turned in the direction depicted in FIG. 5 so as to force the bolt to the left as shown therein and thus dispose the device 10 in an activatable first position. The device can also be used without the lock 20 and thus act as a dead bolt lock with a signal.

In a similar fashion, when it is desired to deactivate the device 10, the key 92 may be turned in the opposite direction as shown in FIG. 7 so as to slide the bolt to the right and thus misalign the contacts and accordingly deactivate the device.

Figure 11:
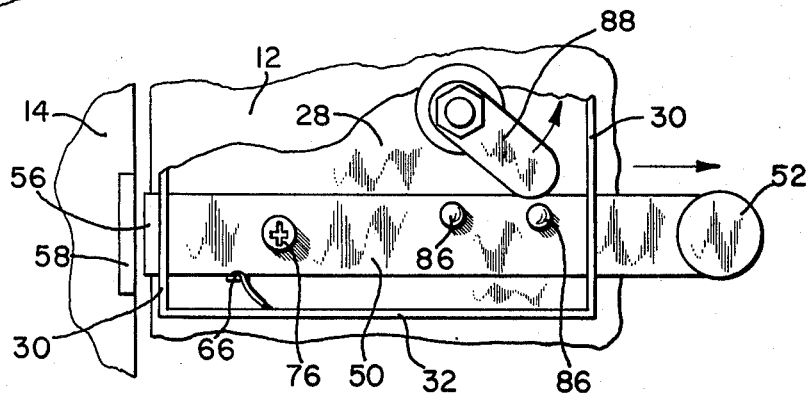
FIG. 11 is an elevational view showing the deactivation assembly shown in FIG. 10, but in a deactivated position.
Figure 12:
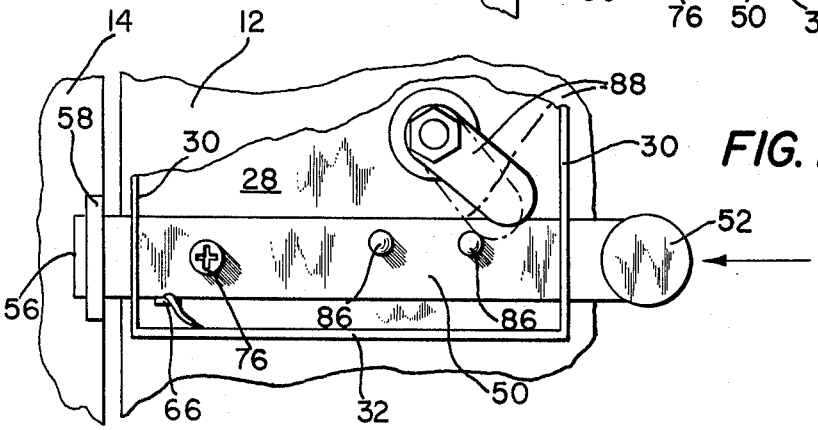
FIG. 12 is an elevational view similar to FIG. 11, but showing how the deactivation assembly may be overridden.

In some cases it is also desirable that the deactivation assembly 84 may be overridden; and in such case the actuation finger 88 may be manually pivoted to the right of the right-hand pin 86 when the bolt is in its deactivated position as shown in FIG. 11. With the actuation finger 88 in such position, the bolt 50 may then be slid to the left as shown in FIG. 12 into its activated position. Accordingly when disposed in such position, even those having a key 92 and seeking to deactivate the device 10 from the outside of the door 12 cannot do so since the normal deactivation rotation of the key 92 will not be effective to move the bolt in the desired direction because such attempted clockwise movement of the actuation finger can only serve to further force the bolt to the left as shown in FIG. 12. In this regard it should be brought out that the cylinder 90 is adapted for less than 360° rotation. In some cases the entire deactivation assembly 84 may be eliminated.

Also, either of the embodiments of the device above described may be utilized with sliding windows and doors as by appropriate mounting of the bolt generally at the end of the sliding door or window which makes contact or near contact with its supporting frame. In either embodiment the device may also function without the SCR 40 or the switch 44 so as to eliminate its reset activation mode in which cases movement of the door serves to shut off the signal device.

While there is shown and described herein certain specific structure embodying this invention, it will be manifest to those skilled in the art that various modification and rearrangements of the parts may be made without departing from the spirit and scope of the underlying inventive concept and that the same is not limited to the particular forms herein shown and described except insofar as indicated by the scope of the appended claims.

What is claimed is:

1. A device for signalling door movement as by attempted entry comprising, a door frame, a door mounted in said frame for movement between respective open and closed positions relative to said frame, a housing having an inner wall affixed to said door including an elongated bolt mounted thereon for transverse movement with respect thereto and to said door between a first non-activatable position wherein said door may be freely opened and a second activatable position, one end of said bolt adapted to contact said door frame in said activatable position so as to fixedly position such with respect to said door frame and so as to enable said door and said housing to move at least slightly relative to and towards said bolt, electrical signal means, a pair of electrical signal contacts on said housing and in opposition to said bolt, a leaf spring having one end connected to one of said contacts and the other end normally disposed in spaced relation with said other contact, said leaf spring contacting said bolt so as to spring bias said bolt away from the inner wall of said housing whereby moving said door towards its open position causes said spring other end and said other contact to engage and said signal to be activated.

2. The device of claim 1, including a bolt strike mounted on said door frame and extending inwardly therefrom, said strike having an opening adapted to receive said one end of said bolt when positioned in said activatable position.

3. The device of claim 1, including key operated means mounted on the outside of said door for moving said bolt between said first and second positions.

4. The device of claim 3, said key operated bolt moving means including a pair of laterally spaced projections rearwardly extending from said bolt, a pivotal finger adapted to extend between said projections and a key operated rotatable shaft mounted in said door and connected to said finger whereby alternate rotation of said shaft causes said finger to force said bolt back and forth by alternate contact with one of said two bolt projections.

5. The device of claim 4, wherein said key operated bolt moving means may be temporarily rendered inoperative by transverse movement of said bolt from the inside of said door to said second activated position and when said finger is disposed to that side of the projection proximal thereto wherein rotation of said shaft also tends to force said bolt into said second position.

* * * * *